US010575097B2

(12) United States Patent
Kang et al.

(10) Patent No.: US 10,575,097 B2
(45) Date of Patent: Feb. 25, 2020

(54) VIBRATION OUTPUT DEVICE HAVING IMPROVED STRUCTURE AND PORTABLE ELECTRONIC DEVICE COMPRISING SAME

(71) Applicant: YEIL ELECTRONICS CO., LTD., Incheon (KR)

(72) Inventors: Yoon Kyu Kang, Wonmi-gu (KR); Jae Yong Kim, Busan (KR)

(73) Assignee: YEIL ELECTRONICS CO., LTD., Incheon (KR)

( * ) Notice: Subject to any disclaimer, the term of this patent is extended or adjusted under 35 U.S.C. 154(b) by 0 days.

(21) Appl. No.: 16/066,120

(22) PCT Filed: Feb. 16, 2017

(86) PCT No.: PCT/KR2017/001733
§ 371 (c)(1),
(2) Date: Jun. 26, 2018

(87) PCT Pub. No.: WO2017/142333
PCT Pub. Date: Aug. 24, 2017

(65) Prior Publication Data

US 2019/0014416 A1 Jan. 10, 2019

(30) Foreign Application Priority Data

Feb. 18, 2016 (KR) ..... 10-2016-0018919
Feb. 15, 2017 (KR) ..... 10-2017-0020425

(51) Int. Cl.
*H04R 9/02* (2006.01)
*H04R 9/06* (2006.01)
(Continued)

(52) U.S. Cl.
CPC ..... *H04R 9/02* (2013.01); *H04R 9/06* (2013.01); *B06B 1/04* (2013.01); *H04R 7/26* (2013.01)

(58) Field of Classification Search
CPC ..... B06B 1/045; H04R 2400/03; H04R 2460/13; H04R 2499/11; H04R 9/025;
(Continued)

(56) References Cited

U.S. PATENT DOCUMENTS

2010/0296691 A1 11/2010 Komatsu
2011/0309691 A1* 12/2011 Park ..... H02K 33/16 310/25
(Continued)

FOREIGN PATENT DOCUMENTS

CN 86200062 U 12/1987
JP H-10108443 A 4/1998
(Continued)

OTHER PUBLICATIONS

International Search Report dated May 10, 2017 for PCT Application No. PCT/KR2017/001733.

*Primary Examiner* — Curtis A Kuntz
*Assistant Examiner* — Julie X Dang
(74) *Attorney, Agent, or Firm* — Moser Taboada

(57) ABSTRACT

According to an embodiment of the present disclosure, provided are a vibration output device and a portable electronic apparatus outputting vibration. An embodiment of the present disclosure may provide a vibration output device including: a magnetic circuit generating vibration; a yoke part contacting an upper surface of the magnetic circuit; an elastic part performing a vibration motion in contact with at least a part of the upper surface of the yoke part, the elastic part including at least two vibration parts which vibrate with the vibration of the magnetic circuit; and a vibration plate contacting at least a part of the upper surface of the yoke part and outputting the vibration to the outside with the vibration of the yoke part, in which the yoke part includes a yoke body contacting the upper surface of the magnetic circuit, and a yoke plate provided on the upper surface of the yoke body
(Continued)

and having a plurality of protruding surfaces on the upper surface of the yoke body, and having different shapes in accordance with the number of vibration parts, and a vibration output speaker including the same.

10 Claims, 8 Drawing Sheets

(51) Int. Cl.
*B06B 1/04* (2006.01)
*H04R 7/26* (2006.01)

(58) Field of Classification Search
CPC ..... H04R 9/06; H04R 9/066; H04R 17/00; H04R 31/006; H04R 11/02; H04R 1/1008; H04R 1/2876; H04R 2201/021; H04R 2205/022; H04R 2209/027; H04R 2400/07; H04R 2440/05; H04R 25/505; H04R 27/00; H04R 29/001; H04R 3/00; H04R 3/12; H04R 5/033; H04R 7/04; H04R 9/046; H04R 1/06; H04R 1/10; H04R 1/1016
USPC ..... 381/396, 417, 412, 413, 326, 380, 113, 381/116; 340/391, 384.7, 388.5
See application file for complete search history.

(56) References Cited

U.S. PATENT DOCUMENTS

| | | | | |
|---|---|---|---|---|
| 2012/0020501 | A1* | 1/2012 | Lee ..... | H04R 1/1091 381/151 |
| 2016/0044395 | A1* | 2/2016 | Fukuda ..... | B06B 1/045 381/151 |

FOREIGN PATENT DOCUMENTS

| | | | |
|---|---|---|---|
| KR | 19990046111 | A | 6/1999 |
| KR | 20010058093 | A | 7/2001 |
| KR | 20100101358 | A | 9/2010 |
| KR | 200454024 | Y1 | 6/2011 |
| KR | 101197917 | B1 | 11/2012 |
| TW | 201043046 | A | 12/2010 |

* cited by examiner (a)

(b)

VIBRATION OUTPUT DEVICE HAVING IMPROVED STRUCTURE AND PORTABLE ELECTRONIC DEVICE COMPRISING SAME

TECHNICAL FIELD

The present disclosure relates to a device that outputs vibration, and more particularly, to a vibration output device including an improved structure and a portable electronic apparatus including the vibration output device.

BACKGROUND ART

In recent years, there has been a series of products using bone conduction technology that becomes widely known as being installed in mobile phones. Various electronic apparatuses using the bone conduction technology, for example, application products such as a speaker or a hearing aid have been commercialized. Temuko Japan that holds a bone conduction related patent plans to launch products adopting the bone conduction technology, which include the speaker, a microphone, and the like which may be used even in a vacuum state and which are undeterred by a use place such as an underwater place, and the like.

In general, sound is recognized as the vibration of the air rings the eardrum, and the vibration is transferred to the cochlea. Contrary to this, in the bone conduction, the vibration is directly transferred from the bone to the cochlea. Because of this principle, the sound is heard even when the ears are closed. Therefore, when the cochlea and the auditory nerve are normal, even if there is a defect in the eardrum, the sound can be heard by the bone conduction.

The bone conduction technology itself has been established before, but there is a hinder in miniaturization for commercialization of the bone conduction technology as a product. This is because an output by the bone conduction is proportional to the size. As a result, Temuko Japan has invested heavily in developing bone conduction speakers in which the number of components is reduced and an internal structure is changed. In addition, the bone conduction speaker for voice communication adopting the bone conduction speaker is also under research.

In general, a sound or vibration output device is a device that outputs sound or vibration force, such as a speaker, a receiver, a buzzer, or a vibration motor (vibrator) that converts an electrical signal input from a signal source into a mechanical signal to output sound or generate the vibration force and also corresponds to a bone conduction output device.

The sound or vibration output device is applied to very various fields according to the size and the purpose. In particular, with the growth of the information and communication industry, adoption of a linear motion vibration motor rapidly increases, which excels a function of the existing rotary vibration motor, as a small sound or vibration output device widely used for vibration calling of a communication terminal, in particular, a small vibration motor, as a touch screen terminal including a smart phone drags popularity.

The reason why application of the linear motion vibration motor to a touch phone including the smart phone and a portable IT device such as a general cellular phone is extended is that a response speed is high and noise is small and a product life-span is also greatly improved as compared with the rotary vibration motor. The response speed means a time required to reach 50% of the vibration force at the maximum displacement and is the most important reason for adopting the linear motion vibration motor.

In recent years, the touch screen terminal evolves to the smart phone to download and use various applications and the applications carry out various functions and feedback vibration suitable for the functions is required and in order to meet the requirement, in the technical field, a vibration motor is required, which is higher in response speed, that is, reaction speed than the linear motion vibration motor in the related art.

DISCLOSURE

Technical Problem

The present disclosure has been made in an effort to provide a vibration output device that directly transfers vibration to a body and skin.

The present disclosure has been made in an effort to prevent a decrease in bone conductivity or a distortion phenomenon due to vibration damping by directly transferring the vibration to the body and the skin.

Technical Solution

According to an embodiment of the present disclosure for achieving the objects, disclosed is a vibration output device having an improved structure. The vibration output device may include: a magnetic circuit generating vibration; a yoke part contacting an upper surface of the magnetic circuit; an elastic part performing a vibration motion in contact with at least a part of the upper surface of the yoke part, in which the elastic part includes at least two vibration parts which vibrate with the vibration of the magnetic circuit; and a vibration plate contacting at least a part of the upper surface of the yoke part and outputting the vibration to the outside with the vibration of the yoke part and the yoke part may include a yoke body contacting the upper surface of the magnetic circuit, and a yoke plate provided on the upper surface of the yoke body and having a plurality of protruding surfaces on the upper surface of the yoke body, and having different shapes in accordance with the number of vibration parts.

According to an embodiment of the present disclosure for achieving the objects, disclosed is a vibration output speaker having an improved structure. The vibration output speaker may include: a control unit controlling a vibration output unit to generate vibration; and the vibration output unit generating the vibration by the control by the control unit, and the vibration output unit may include a magnetic circuit generating the vibration, a yoke part contacting an upper surface of the magnetic circuit, an elastic part performing a vibration motion in contact with at least a part of the upper surface of the yoke part, in which the elastic part includes at least two vibration parts which vibrate with the vibration of the magnetic circuit, and a vibration plate contacting at least a part of the upper surface of the yoke part and outputting the vibration to the outside with the vibration of the yoke part, and the yoke part may include a yoke body contacting the upper surface of the magnetic circuit, and a yoke plate provided on the upper surface of the yoke body and having a plurality of protruding surfaces on the upper surface of the yoke body, and having different shapes in accordance with the number of vibration parts.

Advantageous Effects

The present disclosure can provide a vibration output device that directly transfers vibration to a body and skin.

The present disclosure can prevent a decrease in bone conduction or a distortion phenomenon due to vibration damping by directly transferring the vibration to the body and the skin.

BRIEF DESCRIPTION OF THE DRAWINGS

Various aspects are now described with reference to the drawings and like reference numerals are generally used to designate like elements. In the following embodiments, for a purpose of description, multiple specific detailed matters are presented to provide general understanding of one or more aspects. However, it will be apparent that the aspect(s) can be executed without the specific detailed matters. In other examples, known structures and apparatuses are illustrated in a block diagram form in order to facilitate description of the one or more aspects.

BEST MODE

Figure 1A:
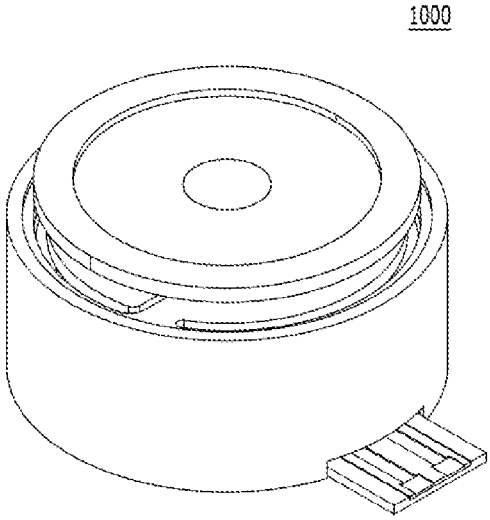
FIGS. 1*a* and 1*b* illustrate an outline and a structure of a vibration output device according to an embodiment of the present disclosure.

The aforementioned objects, features, and advantages of the present disclosure will be more clear through the following embodiments associated with the accompanying drawings. Specific structural or functional descriptions described below are made only for the purposes of describing the embodiments according to the concept of the present disclosure and the embodiments according to the concept of the present disclosure may be carried out in various forms and should not be interpreted as being limited to the embodiments described in the present specification or application.

An embodiment according to a concept of the present disclosure may have various modifications and various forms and specific exemplary embodiments will be illustrated in the drawings and described in detail in the present specification or application. However, this does not limit the embodiments according to the concept of the present disclosure to specific disclosed forms, and it should be understood that the present disclosure covers all the modifications, equivalents and replacements included within the idea and technical scope of the present disclosure.

Terms including as first and/or second, and the like are used for describing various constituent elements, but the constituent elements are not limited by the terms. The terms may be used only for a purpose of distinguishing one component from other components and for example, a first component may be referred to as a second component, and similarly, the second component may be referred to even as the first component without departing from the scope of the present disclosure according to a concept of the present disclosure.

It should be understood that, when it is described that a component is "connected to" or "accesses" another component, the component may be directly connected to or access the other component or a third component may be present therebetween. In contrast, it should be understood that, when it is described that a component is "directly connected to" or "directly access" or "contact" another element, no component is present between the component and another component. Meanwhile, other expressions describing the relationship of the components, that is, expressions such as "between" and "directly between" or "adjacent to" and "directly adjacent to" should be similarly interpreted.

Terms used in the present specification are used only to describe specific embodiments, and are not intended to limit the present disclosure. A singular form may include a plural form if there is no clearly opposite meaning in the context. In the present specification, it should be understood that term "include" or "have" indicates that a feature, a number, a step, an operation, a component, a part or the combination thereof which are implemented are present, but does not exclude a possibility of presence or addition of one or more other features, numbers, steps, operations, components, parts or combinations thereof, in advance.

If not contrarily defined, all terms used herein including technological or scientific terms have the same meanings as those generally understood by a person with ordinary skill in the art. Terms which are defined in a generally used dictionary should be interpreted to have the same meaning as the meaning in the context of the related art, and are not interpreted as an ideal meaning or excessively formal meanings unless clearly defined in the present specification.

Hereinafter, embodiments of the present disclosure will be described in detail with reference to the accompanying drawings.

Figure 1B:
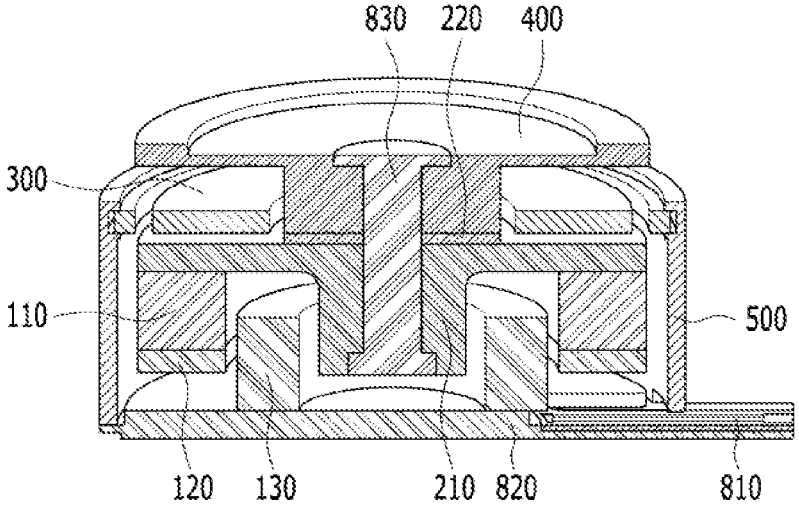

FIGS. 1*a* and 1*b* illustrate an outline and a structure of a vibration output device 1000 according to an embodiment of the present disclosure.

FIG. 1*a* is a diagram illustrating the outline of a vibration output device 1000 according to an embodiment of the present disclosure and FIG. 1*b* is a diagram illustrating the structure of the vibration output device 1000 according to an embodiment of the present disclosure.

Referring to FIG. 1*b*, the vibration output device 1000 according to an embodiment of the present disclosure may include a magnetic circuit 100, a yoke part 200, an elastic part 300, and a housing 500.

The magnetic circuit 100 may generate vibration. The magnetic circuit 100 may include a magnet 110 and a top plate 120. Herein, the magnet 110 may be made of a material having magnetic force and may vibrate according to a change in a peripheral magnetic field. Further, the top plate 120 may concentrate the magnetic force of the magnet 110.

The magnetic circuit 100 may be provided at a predetermined distance from a coil 130. When an AC signal is applied to the coil 130, the magnet 110 may vibrate according to a strength and a direction of the AC signal applied to the coil 130 and a magnitude of a frequency. In other words, the magnet 110 may serve as a vibrator that vibrates according to the AC signal applied to the coil 130.

This is due to Fleming's left-hand rule that a conductor placed in a magnetic field receives force in a predetermined direction and the theory related to the principle is known in the art and a detailed description will be omitted.

In the related art, a vibration motor using a brush and a commutator is often used, but there is a problem in excessive noise and miniaturization. The vibration output device 1000 of the present disclosure includes the coil 130 and the magnetic circuit 100 in order to generate the vibration and the vibration generated by the magnetic circuit 100 is transmitted to the yoke part 200 which is in contact with an upper surface of the magnetic circuit 100.

The yoke part 200 may include a yoke body 210 contacting the upper surface of the magnetic circuit 100 and a yoke plate 220 provided on the upper surface of the yoke body 210 and forming a plurality of protruding surfaces on the upper surface of the yoke body 210. In this case, the yoke plate 220 may be provided in a different shape depending on the number of vibration parts 310.

The yoke plate 220 forms a plurality of protruding surfaces on the upper surface of the yoke body 210 so that at least one space in which the vibration part 310 of the elastic part 300 may vibrate may be secured on the upper surface of the yoke part 200.

The yoke part 200 may be provided so as to be in contact with the upper surface of the magnetic circuit 100. Herein, the yoke part 200 being in contact with the magnetic circuit 100 means that a separate vibration transfer body is not provided between the yoke part 200 and the magnetic circuit 100, but the yoke part 200 is provided so that the vibration generated from the magnetic circuit 100 is directly transferred to the yoke part 200. In other words, the yoke part 200 is sequentially laminated on the upper surface of the magnetic circuit 100 or the magnetic circuit 100 and the yoke part 200 are integrally formed at the time of manufacture so as to directly transfer the vibration generated from the magnetic circuit 100 to the yoke part 200.

The elastic part 300 may include a plurality of components. For example, the elastic part 300 includes at least two vibration parts 310 vibrating according to the movement of the magnetic circuit 100, a fixing part 320 fixing the elastic part 300 to the housing 500, and at least one connecting part 315 connecting the vibration part 310 and the fixing part 320. In this case, the plurality of vibration parts 310, the connecting parts 315, and the fixing parts 320 may be integrally formed. This is only an embodiment of the present disclosure and the components of the elastic part 300 are not limited thereto.

The vibration plate 400 contacts the upper surface of the yoke part 200 and passes through an opening 330 (see FIG. 3*a*) of the elastic part 300 contacting the upper surface of the yoke part 200 to be exposed to the outside. In addition, the vibration may be output to the outside in accordance with the vibration of the magnetic circuit 100.

The upper surface and a lower surface of the housing 500 are opened and side surfaces are closed, and as a result, the housing 500 may have a space therein. For example, the housing 500 may have a shape of a cylinder having the upper surface and the lower surface which are opened. Further, the housing 500 may have a shape of a rectangle having the upper surface and the lower surface which are opened, but is not limited thereto.

The housing 500 may include at least one component of the vibration output device in an internal space. For example, the internal space of the housing 500 may include the coil 130, the magnetic circuit 100, the yoke part 200, the elastic part 300, or a combination thereof, but is not limited thereto.

The housing 500 may be molded into various members. The housing 500 may be formed of a metal member (e.g., iron, nickel, copper, etc.) and may be formed of reinforced plastic, but is not limited thereto.

The vibration output device 1000 may include a PCB substrate 810. The PCB substrate 810 may be provided on at least a part of the upper surface of a cap 820. The cap 820 may connect and fix the housing 500 and the PCB substrate 810.

According to another embodiment of the present disclosure, the vibration plate 400 and the yoke part 200 may be combined by being attached directly without a rivet 830.

Figure 2:
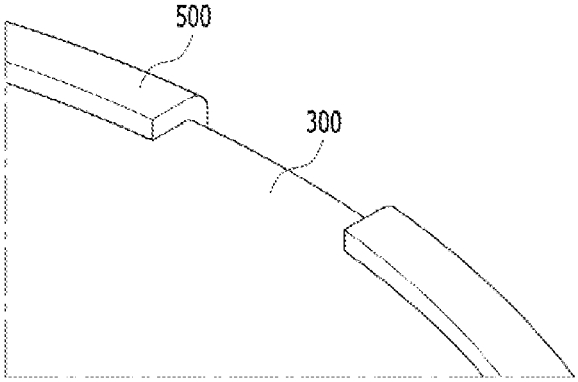
FIG. 2 is a diagram for describing a method for coupling an elastic part and a housing according to an embodiment of the present disclosure.

FIG. 2 is a diagram for describing a method for coupling an elastic part 300 and a housing 500 according to an embodiment of the present disclosure.

According to an embodiment of the present disclosure, the vibration output device 1000 may include the housing 500 and the elastic part 300.

The housing 500 and the elastic part 300 may be combined in various methods. For example, the elastic part 300 is attached onto an inner surface of the housing 500 to be coupled to the housing 500. Further, the elastic part 300 may be coupled to the housing 500 by curling of the housing 500.

The curling in the specification means bending at a predetermined angle and the predetermined angle may be determined by various methods. For example, the predetermined angle may be determined as 90 degrees and may be determined to be an optimum angle for fixing the elastic part 300, but is not limited thereto.

According to an embodiment of the present disclosure, at least a part of an upper portion of the housing 500 is curled in the direction of the elastic part 300, so that the elastic part 300 may be seated on the upper surface of the housing 500.

Figure 3A:
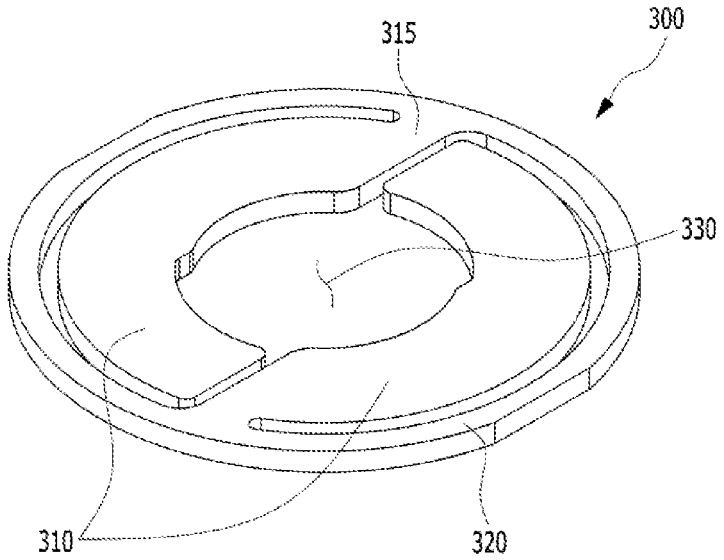
FIGS. 3*a*, 3*b*, and 3*c* illustrate elastic parts with two, three, and four vibration parts according to an embodiment of the present disclosure.
Figure 3B:
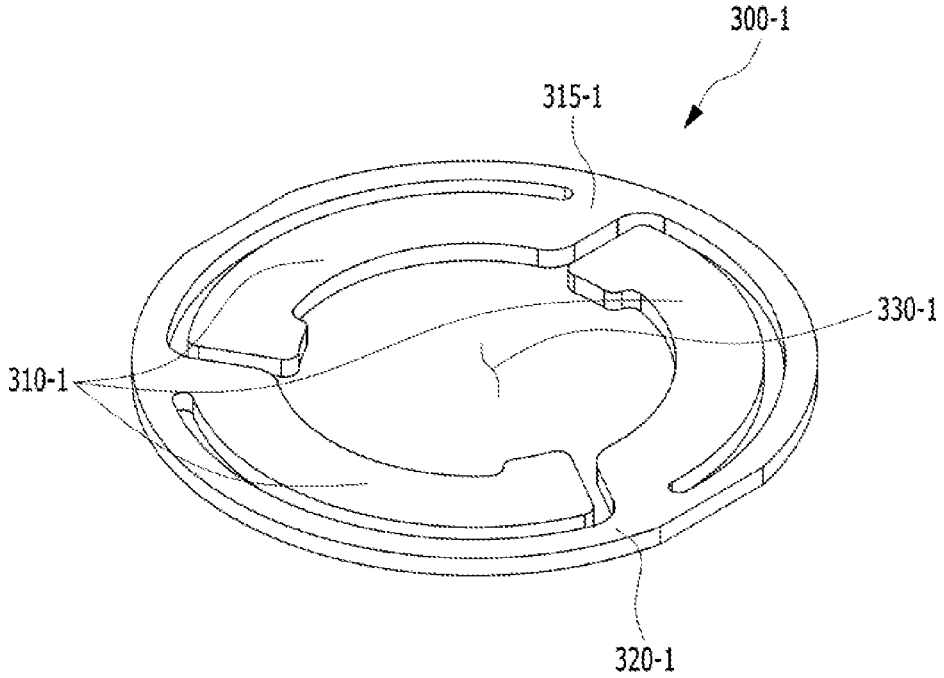
Figure 3C:
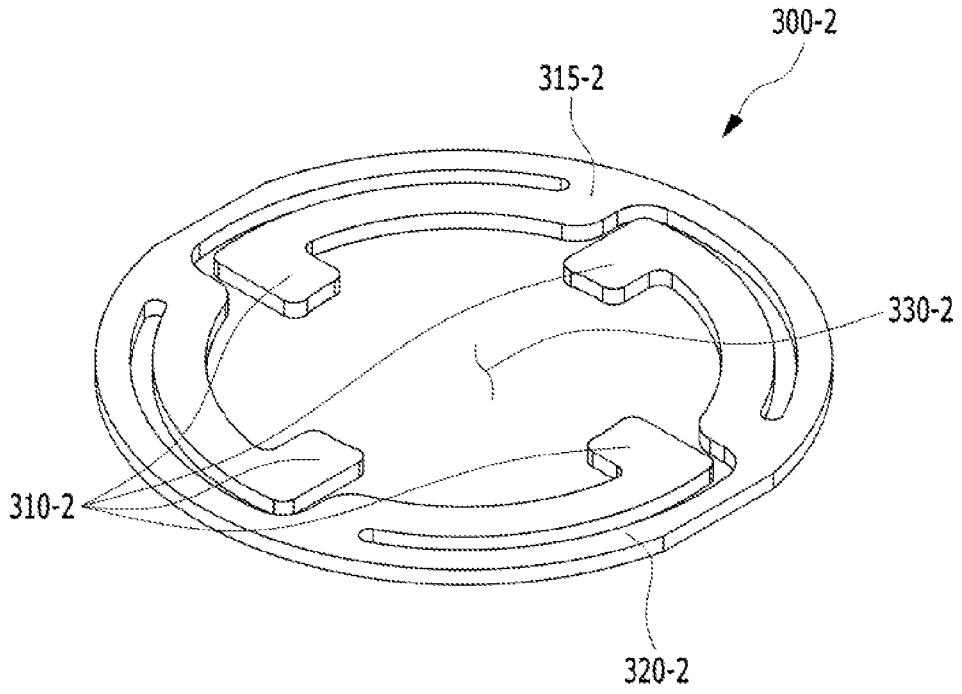

FIGS. 3*a*, 3*b*, and 3*c* illustrate elastic parts 300 with two, three, and four vibration parts 310 according to an embodiment of the invention.

The elastic parts 300, 300-1 and 300-2 (hereinafter, referred to as 300) according to an embodiment of the present disclosure may include at least two vibration parts 310, 310-1, and 310-2 (hereinafter, referred to as 310) that vibrate with the movement of the magnetic circuit 100 and fixing parts 320, 320-1, and 320-2 (hereinafter, referred to as 320) that fix the elastic part 300 to the housing 500. Further, the elastic part 300 may include at least one connection part 315, 315-1, and 315-2 (hereinafter referred to as 315) that connects the vibration part 310 and the fixing part 320. In this case, the components of the elastic part 300 may be integrally formed.

A plurality of vibration parts 310 of the elastic part 300 may vibrate with the vibration of the magnetic circuit 100 in contact with at least a part of the upper surface of the yoke part 200. Since a bottom surface of the vibration part 310 of the elastic part 300 is in contact with the upper surface of the yoke portion 200 and the bottom surface of the yoke part 200 is in contact with an upper surface of the magnetic circuit 100, the vibration generated by the magnetic circuit 100 may be directly transferred up to the elastic part 300 through the yoke part 200.

For example, when the magnetic circuit 100 moves upward, the yoke part 200 contacting the upper surface of the magnetic circuit 100 and the vibration part 310 of the elastic part 300 contacting the upper surface of the yoke part 200 also move upward. In this case, the fixing part 320 of the elastic part 300 may be fixed to the housing 500 and may not move.

The vibration part 310 of the elastic part 300 moving upward may receive force downward by elasticity and the vibration part 310 of the elastic part 300 may move downward. As such a process is repeated, the magnetic circuit 100 and the yoke part 200 may perform a vibration motion of moving vertically.

As another example, when the magnetic circuit 100 moves downward, the yoke part 200 coupled to the upper surface of the magnetic circuit 100 and the vibration part 310 of the elastic part 300 coupled to the upper surface of the yoke part 200 also move downward. In this case, the fixing part 320 of the elastic part 300 may be fixed to the housing 500 and may not move.

The vibration part 310 of the elastic part 300 moving downward may receive force upward by the elasticity of the elastic part 300 and the vibration part 310 of the elastic part 300 may move upward. As such a process is repeated, the magnetic circuit 100 and the yoke part 200 may perform the vibration motion of moving vertically.

Referring to FIG. 3*a*, when there are two vibration parts 310 of the elastic part 300, two connection parts 315 may be provided. In this case, the connection part 315 may connect two vibration parts 310 onto the inner surface of the fixing part 320.

Referring to FIG. 3*b*, when there are three vibration parts 310-1 of the elastic part 300-1, three connection parts 315-1 may be provided. In this case, the connection part 315-1 may connect three vibration parts 310-1 onto the inner surface of the fixing part 320-1.

Referring to FIG. 3*c*, when there are four vibration parts 310-2 of the elastic part 300-2, four connection parts 315-2 may be provided. In this case, the connection part 315-2 may connect four vibration parts 310-2 onto the inner surface of the fixing part 320-2.

According to an embodiment of the present disclosure, the plurality of vibration parts 310 of the elastic part 300 may vibrate independently of each other. For example, when the yoke part 200 moves vertically without keeping horizontal, at least one vibration part 310 may vibrate downward and at least one of the remaining vibration parts 310 may vibrate upward.

Openings 330, 330-1, and 330-2 (hereinafter, referred to as 330) may be located at the center of the elastic part 300. Further, the vibration part 310 may be located outside the opening 330 of the elastic part 300 and the fixing part 320 may be located outside the vibration part 310.

Further, a space may be formed between the vibration part 310 and the fixing part 320 so that the vibration part 310 may not collide with the fixing part 320 when the vibration part 310 vibrates.

The elastic part 300 may include a plurality of vibration parts 310 and each of the vibration parts 310 may be connected to the fixing part 320 by the connection part 315. In this case, the components of the elastic part 300 may be integrally formed.

The connection parts 315, 315-1, and 315-2 (hereinafter, referred to as 315) may be provided as many as the number of vibration parts 310, 310-1, and 310-2 (hereinafter, referred to as 310) and the number of connection parts 315 is not limited thereto.

The elastic part 300 may include the openings at the center thereof. For example, the elastic part 300 may include the opening 330 and the elastic part 300 may be integrally formed so that the vibration plate 400 is exposed to the outside through the opening 330. The vibration plate 400 is exposed to the outside to directly contact a body and the like.

The elastic part 300 may be seated on the upper surface of the housing 500 in various ways. For example, the elastic part 300 is attached onto the inner surface of the housing 500 to be seated onto the upper surface of the housing 500.

Further, as another example, at least a part of the upper portion of the housing 500 is curled in the direction of the elastic part 300, so that the elastic part 300 may be seated on the upper surface of the housing 500. Further, at least a part of the inner surface of the upper portion of the housing 500 is curled in the direction of the elastic part 300, so that the elastic part 300 may be seated on the upper surface of the housing 500.

The elastic part 300 is coupled to the housing 500 to be fixed. For example, the fixing part 320 of the elastic part 300 is coupled to the housing 500 to be fixed.

According to another embodiment, the elastic part 300 may be formed integrally with the housing 500. For example, the elastic part 300 and the housing 500 may be integrally formed by a casting method using a metal member, but are not limited thereto.

Figure 4:
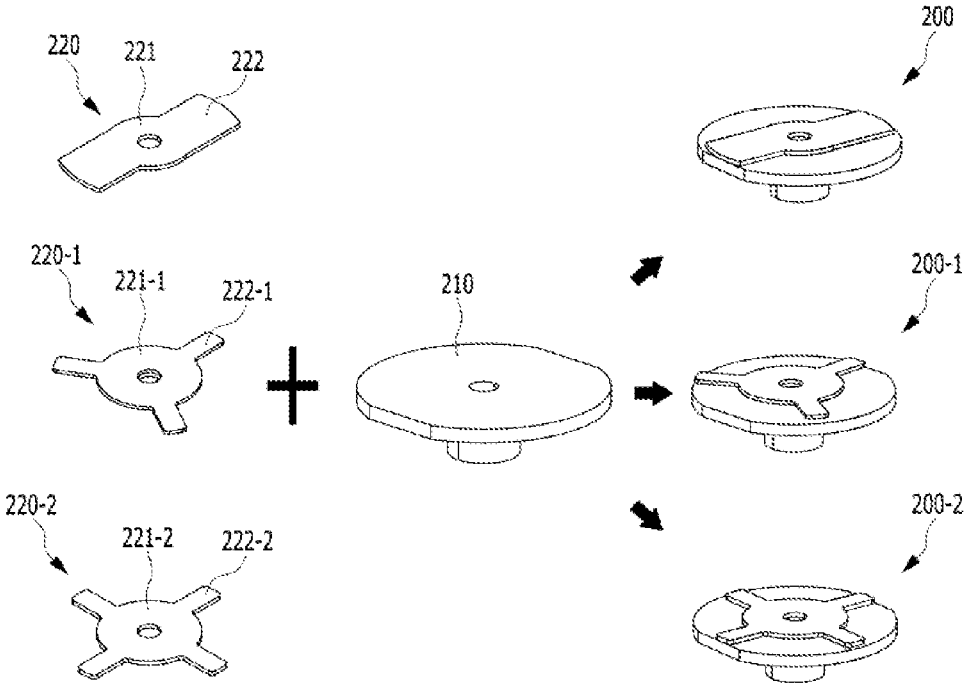
FIG. 4 illustrates yoke parts having different shapes when the number of vibration parts is two, three, and four, according to an embodiment of the present disclosure.

FIG. 4 illustrates yoke parts 200 having different shapes when the number of vibration parts 310 is two, three, and four, according to an embodiment of the present disclosure.

According to an embodiment of the present disclosure, the yoke part 200 may transfer the vibration generated by the magnetic circuit 100 to the elastic part 300. For example, when the magnetic circuit 100 vibrates according to the AC signal applied to the coil 130, the vibration is directly transferred to the yoke part 200 contacting the magnetic circuit 100 and the vibration transferred to the yoke part 200 may be transferred up to the elastic part 300 contacting the upper surface of the yoke part 200.

According to an embodiment of the present disclosure, the yoke parts 200, 200-1, and 200-2 (hereinafter, referred to as 200) may include a yoke body 210 and yoke plates 220, 220-1, and 220-2 (hereinafter, referred to as 220).

The yoke body 210 may be in contact with the upper surface of the magnetic circuit 100. The upper surface of the yoke body 210 may be formed in a shape of a circular plate and the bottom surface of the yoke body 210 may be formed in a shape in which a cylinder is attached to the center of the circular plate. Further, a hole may be formed at the center of the circular plate so that the rivet 830 may be inserted. The shape of the yoke body 210 described above is only an embodiment and the shape of the yoke body 210 may be diversified.

The yoke plate 220 is provided on the upper surface of the yoke body 210 to form a plurality of protruding surfaces on the upper surface of the yoke body 210 and may have different shapes according to the number of vibration parts 310. The yoke plate 220 may include at least one plate body 221 and protrusions 222 as many as the number of vibration parts 310. For example, when two vibration parts 310 are provided, the yoke plate 220 may include one plate body 221 and two protrusions 222.

According to an embodiment of the present disclosure, when the elastic part 300 includes two vibration parts 310, the yoke plate 220 may include the plate body 221 and two protrusions 222 formed on the outer periphery of the plate body 221. The yoke plate 220 contacting the upper surface of the yoke body 210 includes two protrusions 222 so that two protrusion surfaces may be formed on the upper surface of the yoke body 210. In this case, the two protruding surfaces may be in contact with different vibration parts 310, respectively.

According to an embodiment of the present disclosure, when the elastic part 300-1 includes three vibration parts 310-1, the yoke plate 220-1 may include the plate body 221-1 and two protrusions 222-1 formed on the outer periphery of the plate body 221-1. The yoke plate 220-1 contacting the upper surface of the yoke body 210 includes three protrusions 222-1 so that three protruding surfaces may be formed on the upper surface of the yoke body 210. In this case, the three protruding surfaces may be in contact with different vibration parts 310-1, respectively.

According to an embodiment of the present disclosure, when the elastic part 300-2 includes four vibration parts 310-2, the yoke plate 220-2 may include the plate body 221-2 and four protrusions 222-2 formed on the outer periphery of the plate body 221-2. The yoke plate 220-2 contacting the upper surface of the yoke body 210 includes four protrusions 222-2 so that four protruding surfaces may be formed on the upper surface of the yoke body 210. In this case, the four protruding surfaces may be in contact with different vibration parts 310-2, respectively.

The protrusions 222, 222-1, and 222-2 (hereinafter, referred to as 222) may be provided at the same height as the plate bodies 221, 221-1, and 221-2 (hereinafter, referred to as 221) and may be provided in a rectangular shape extending from the center of the plate body 221 in a straight line. In this case, when viewed based on the plate body 221, an outer peripheral surface of the protrusion 222 may be provided in a curved shape.

The protrusion 222 may be provided integrally with the plate body 221 and the shape of the yoke plate 220 is just an embodiment of the present disclosure and is not limited thereto.

The yoke plate 220 may be seated on the upper surface of the yoke body 210. For example, the yoke plate 220 may contact at least a part of the upper surface of the yoke body 210, may be attached to at least a part of the upper surface of the yoke body 210, and may be formed integrally with the yoke body 210, but is not limited thereto.

As the yoke plate 220 is seated on the upper surface of the yoke body 210, the yoke part 200 may include an upper surface on which at least one protruding surface is formed. A space in which the vibration part 310 of the elastic part 300 may vibrate may be formed on the upper surface of the yoke part 200 by at least one protruding surface formed on the upper surface of the yoke part 200.

In this case, a part of the elastic part 300 may contact at least a part of the upper surface of the yoke plate 220 of the yoke part 200. When the magnetic circuit 100 vibrates according to the AC signal applied to the coil 130, the vibration generated by the magnetic circuit 100 may be transferred to the yoke part 200 and the vibration transferred to the yoke part 200 may be transferred to the elastic part 300 contacting the upper surface of the yoke part 200.

Figure 5:
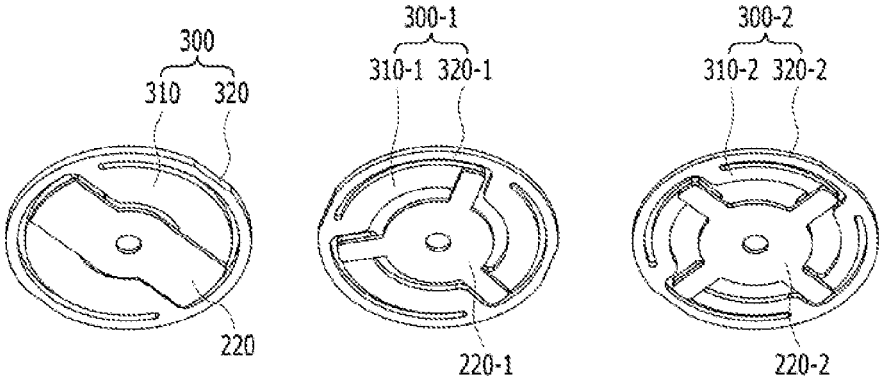
FIG. 5 is a diagram for describing a method for contacting the elastic part and the yoke part according to an embodiment of the present disclosure.

FIG. 5 is a diagram for describing a method for contacting an elastic part 300 and a yoke part 200 according to an embodiment of the present disclosure.

The yoke part 200 may include the yoke body 210 and the yoke plate 220 and the elastic part 300 may include the vibration part 310 and the fixing part 320.

At least a part of the upper surface of the yoke plate 220 may be in contact with at least a part of the bottom surface of the vibration part 310. In this case, since a plurality of protruding surfaces is formed on the upper surface of the yoke part 200 by the yoke plate 220, at least one space may be formed in which the vibration part 310 may vibrate. Therefore, vertical vibration of the magnetic circuit 100 may be directly transferred to the vibration part 310 of the elastic part 300 through the yoke part 200.

The fixing part 320 fixes an outer surface of the elastic part 300 to the housing 500 so as to fix the remaining components of the elastic part 300 except for the vibration part 310 not to vibrate by the yoke part 200.

According to an embodiment of the present disclosure, when the elastic part 300 includes two vibration parts 310, the yoke plate 220 of the yoke part 200 may include two protrusions 222. In this case, each of the two protrusions 222 may be in contact with one vibration part 310. Therefore, the vibration of the yoke part 200 may be directly transferred to the two vibration parts 310.

According to an embodiment of the present disclosure, when the elastic part 300-1 includes three vibration parts 310-1, the yoke plate 220-1 of the yoke part 200-1 may include three protrusions 222-1. In this case, each of the three protrusions 222-1 may be in contact with one vibration part 310-1. Therefore, the vibration of the yoke part 200-1 may be directly transferred to the three vibration parts 310-1.

According to an embodiment of the present disclosure, when the elastic part 300-2 includes four vibration parts 310-2, the yoke plate 220-2 of the yoke part 200-2 may include four protrusions 222-2. In this case, each of the four protrusions 222-2 may be in contact with one vibration part 310-2. Therefore, the vibration of the yoke part 200-2 may be directly transferred to the four vibration parts 310-2.

According to an embodiment of the present disclosure, the vibration parts 310, 310-1, and 310-2 of the elastic parts 300, 300-1, and 300-2 may independently vibrate according to motion patterns of the yoke parts 200, 200-1, and 200-2.

For example, when the yoke part 200-1 moves vertically without keeping horizontal, when there are three vibration parts 310-1, two vibration parts 310-1 may vibrate upward and the remaining one vibration part 310-1 may vibrate downward.

The elastic part 300 and the yoke part 200 may be combined in various ways. For example, at least a part of the bottom surface of the elastic part 300 and at least a part of the upper surface of the yoke part 200 are attached, so that the elastic part 300 and the yoke part 200 may be coupled to each other. Further, the elastic part 300 and the yoke part 200 may be coupled to each other by the rivet 830. In addition, the elastic part 300 and the yoke part 200 may be integrally formed and coupled to each other, but are not limited thereto.

Figure 6:
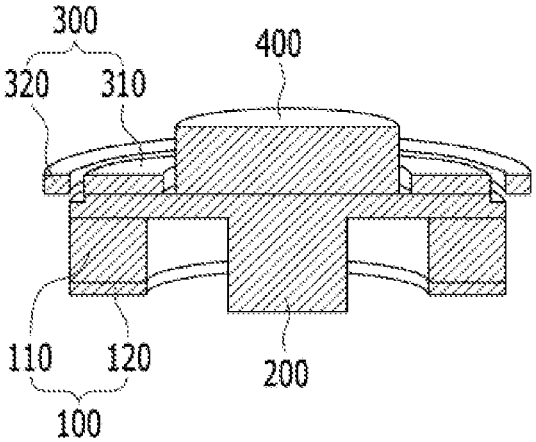
FIG. 6 is a diagram for describing a method for coupling components of a vibration output device without a rivet according to an embodiment of the present disclosure.

FIG. 6 is a diagram for describing a method for coupling components of a vibration output device 1000 without a rivet 830 according to an embodiment of the present disclosure.

According to one embodiment of the present disclosure, the magnetic circuit 100 may include a top plate 120 and a magnet 110. The magnet 110 may be made of a material having magnetic force and may vibrate according to a change in a peripheral magnetic field. Further, the top plate 120 may concentrate the magnetic force of the magnet 110.

The upper surface of the magnetic circuit 100 may be coupled to at least a part of the bottom surface of the yoke part 200. In this case, the magnetic circuit 100 is directly attached to the yoke part 200 to be coupled to the yoke part 200.

The magnetic circuit 100 may be coupled to at least a part of the bottom surface of the yoke part 200 and at least a part of the elastic part 300 may be coupled to at least a part of the upper surface of the yoke part 200. For example, the vibration part 310 of the elastic part 300 may be attached to at least a part of the upper surface of the yoke part 200.

In this case, the upper surface of the yoke part 200 may have a form of a disc having no protruding surface. In addition, at least one protruding surface is formed on the upper surface of the yoke part 200 to form a space in which the elastic part 300 may vibrate, but the present disclosure is not limited thereto.

The vibration plate 400 may be additionally in contact with at least a part of the upper surface of the yoke part 200. In this case, the vibration plate 400 may be attached onto the upper surface of the yoke part 200.

According to an embodiment of the present disclosure, the magnetic circuit 100 is attached to at least a part of the bottom surface of the yoke part 200, the elastic part 300 is attached to at least a part of the upper surface of the yoke part 200, and the vibration plate 400 is attached to at least a part of the upper surface of the yoke part 200 to provide the vibration output device 1000 in which the rivet 830 is omitted.

Figure 7:
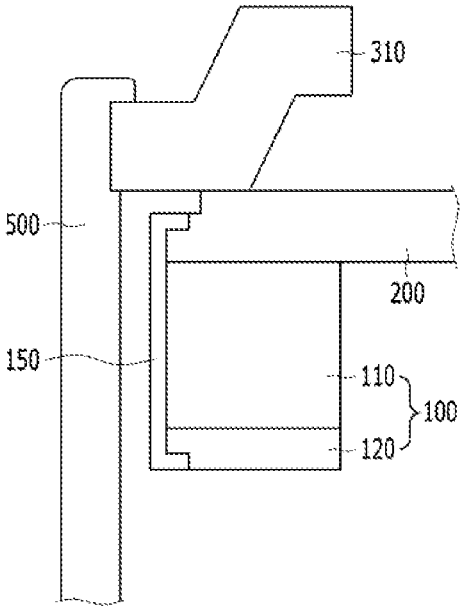
FIG. 7 illustrates a structure of a vibration output device according to another embodiment of the present disclosure.

FIG. 7 illustrates a structure of a vibration output device 1000 according to another embodiment of the present disclosure.

According to another embodiment of the present disclosure, the magnetic circuit 100 and the yoke part 200 may be fixed by a magnetic circuit guide 150. In this case, the magnetic circuit 100 and the yoke part 200 are not directly attached to each other and may be coupled by the magnetic circuit guide 150.

The magnetic circuit guide 150 is in contact with one surface of each of the magnetic circuit 100 and the yoke part 200 to couple the magnetic circuit 100 and the yoke part 200 to each other. For example, the magnetic circuit guide 150 is curled to couple the magnetic circuit 100 and the yoke part 200 to each other.

For example, the magnetic circuit guide 150 may be located in contact with the outer surface of the magnetic circuit 100 and at least a part of a lower end of the magnetic circuit guide 150 may be curled in the direction of the magnetic circuit 100. Further, the magnetic circuit guide 150 may be located in contact with the outer surface of the yoke part 200 and at least a part of an upper end of the magnetic circuit guide 150 may be curled in the direction of the yoke part 200. In this case, the magnetic circuit guide 150 is curled to couple the magnetic circuit 100 and the yoke part 200 to each other.

According to another embodiment of the present disclosure, the elastic part 300 may include various types of structures.

For example, the vibration part 310 of the elastic part 300 has two bent portions bent at a predetermined angle to secure the space in which the vibration part 310 may vibrate.

The shapes and the number of bent portions described above are just an example of the present disclosure and the present disclosure is not limited thereto.

Figure 8:
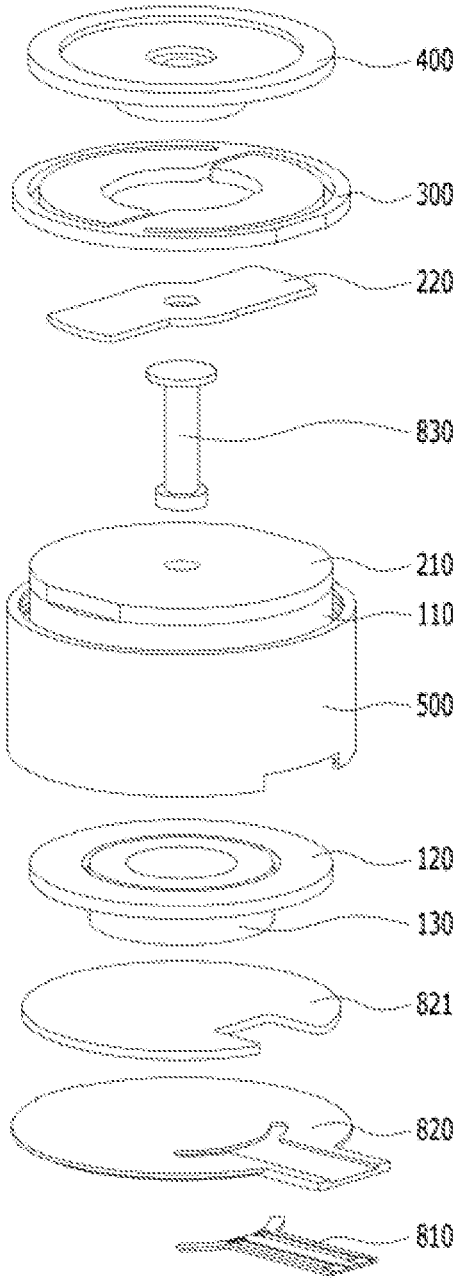
FIG. 8 is an exploded view illustrating a vibration output device having two vibration parts according to an embodiment of the present disclosure.

FIG. 8 is an exploded view illustrating a vibration output device 1000 having two vibration parts 310 according to an embodiment of the present disclosure.

According to an embodiment of the present disclosure, the vibration output device 1000 may include a PCB substrate 810. The PCB substrate 810 may be provided on at least a part of the upper surface of a cap 820. The cap 820 may connect and fix the housing 500 and the PCB substrate 810. As described above, the upper and the lower surface of the housing 500 have a shape of a cylinder, and as a result, the housing 500 may have a space therein. The coil 130 may be provided in an internal space of the housing 500. The coil 130 may provide a change in magnetic field in response to an externally applied AC signal. The magnetic circuit 100 may be provided at a predetermined distance from the coil 130 while being not in contact with the coil 130. The magnetic circuit 100 may include the top plate 120 that may concentrate the magnetic force of the magnet 110.

The yoke part 200 may be provided on the upper surface of the magnetic circuit 100 and the vibration of the magnetic circuit 100 may be transferred to the yoke part 200. In this case, the magnetic circuit 100 is directly attached to the yoke part 200 to be coupled to the yoke part 200 and may be coupled to the yoke part 200 by the magnetic circuit guide 150.

The yoke part 200 may include the yoke body 210 and the yoke plate 220.

The upper surface of the yoke part 200 may have various shapes. For example, the upper surface of the yoke part 200 may have the form of a flat disk without a protruding surface. In addition, the upper surface of the yoke part 200 includes at least one protruding surface by the yoke plate 220, thereby forming a space in which the elastic part 300 may vibrate.

The vibration part 310 of the elastic part 300 may be in contact with a part of the upper surface of the yoke part 200 and the fixing part 320 of the elastic part 300 may contact at least a part of the inner surface of the housing 500. In this case, the elastic part 300 may be coupled to the housing 500 by the curling of the housing 500 and may be coupled to the housing 500 by being directly attached to the inner surface of the housing 500 and the present disclosure is not limited thereto.

The vibration plate 400 is provided on the upper surface of the yoke part 200 to transmit vibration of the magnetic circuit 100 to a user or the like. In addition, a through hole through which the rivet 830 may be connected may be formed at the center of the yoke part 200 and the vibration plate 400.

At least some of the respective components described above may be coupled by the rivet 830. For example, the elastic part 300, the yoke part 200, and the vibration plate 400 may be coupled to each other by the rivet 830.

Further, the respective components may be coupled in different ways without the rivet 830. For example, the elastic part 300 is directly attached to the yoke part 200 and the vibration plate 400 is also directly attached to the yoke part 200, so that the vibration output device 1000 may have a structure in which the rivet 830 is omitted.

An embodiment of the present disclosure may provide a portable electronic apparatus including the aforementioned vibration output device. The portable electronic apparatus may include an electronic apparatus that requires transfers of a voice signal or a vibration signal. For example, the portable electronic apparatus may be any one of various electronic apparatuses including a portable terminal, a mobile terminal, a telematics terminal, a notebook computer, a digital broadcasting terminal, a personal digital assistant (PDA), a Wibro terminal, an Internet protocol television (IPTV) terminal, an audio video navigation (AVN) terminal, a portable multimedia player (PMP), a navigation terminal (a car navigation device), a speaker, and the like. Further, the portable electronic apparatus may include Google glass by Google.

Figure 9:
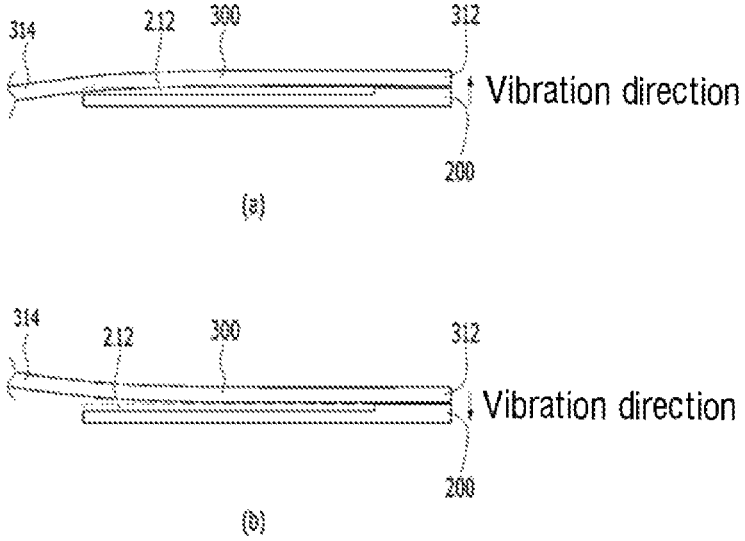
FIG. 9 is a schematic diagram illustrating that the elastic part vibrates in a predetermined space according to an embodiment of the present disclosure.

FIG. 9 is a schematic diagram illustrating that the elastic part 300 vibrates in a predetermined space according to an embodiment of the present disclosure.

Referring to FIG. 9*a*, when the magnetic circuit 100 moves upward, the yoke part 200 contacting the upper surface of the magnetic circuit 100 also moves upward and the vibration part 310 of the elastic part 300 also moves in the same direction. In this case, since the fixing part 320 of the elastic part 300 does not move, the elastic part 300 may be bent by the elasticity. In order to bend the elastic part 300, a space 212 in which the elastic part 300 may be bent needs to be provided. Therefore, the space 212 in which the elastic part 300 may perform a vibration motion may be provided on the upper surface of the yoke part 200 according to an embodiment of the present disclosure.

Referring to FIG. 9*b*, when the magnetic circuit 100 moves downward, the yoke part 200 contacting the upper surface of the magnetic circuit 100 also moves downward and the vibration part 310 of the elastic part 300 also moves in the same direction. In this case, since the fixing part 320 of the elastic part 300 does not move, the elastic part 300 may be bent by the elasticity.

In FIG. 9, a degree of bending of the elastic part 300 may be schematically illustrated, but the scope of the present disclosure is not limited to an elastic modulus of the specified elastic part 300 or a bending angle of the elastic part 300. However, in order to increase a strength of the vibration, vibration widths of the yoke part 200 and the elastic part 300 need to increase and the space 212 in which the elastic part 310 vibrates needs to be secured to be large, and as a result, various shapes of yoke plates 220 are provided on the upper surface of the yoke part 200 according to performance of the vibration output device 1000, thereby providing the space 212 having various volumes on the upper surface of the yoke part 200.

It is necessary to provide a fixed reference point so that the vibration part 310 of the elastic part 300 may vibrate in order for the elastic part 300 according to an embodiment of the present disclosure to perform the vibration motion of moving vertically. Therefore, the elastic part 300 according to an embodiment of the present disclosure may include the fixing part 320. The fixing part 320 of the elastic part 300 may be coupled to a part which does not vibrate, such as the housing 500.

Figure 10:
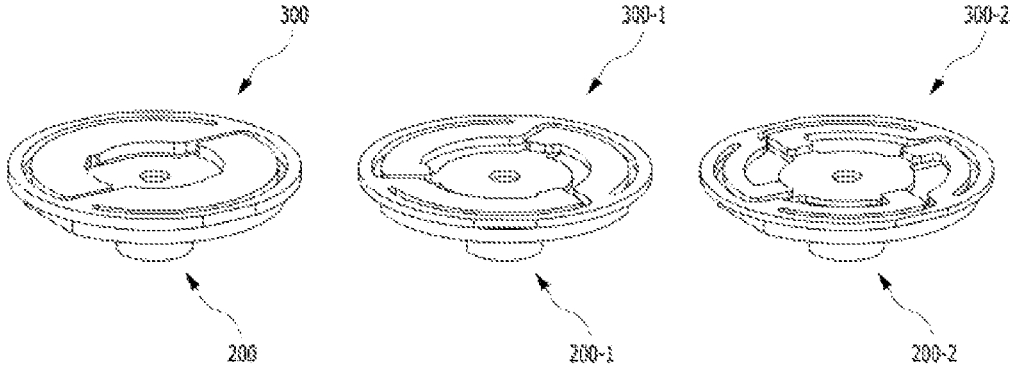
FIG. 10 illustrates the elastic part abutting an upper surface of the yoke part according to an embodiment of the present disclosure.

FIG. 10 illustrates the elastic part 300 abutting an upper surface of the yoke part 200 according to an embodiment of the present disclosure.

Referring to FIG. 10, the elastic part 300 included in the vibration output device 1000 according to an embodiment of the present disclosure may be in contact with a part of the upper surface of the yoke part 200. For example, the elastic part 300 included in the vibration output device 1000 may include the vibration portion 310 and the fixing part 320 and the vibration part 310 of the elastic part 300 may be in contact with at least a part of the upper surface of the yoke part 200.

For example, when the yoke part 200 includes the yoke plate 220, the vibration part 310 of the elastic part 300 may be in contact with at least a part of the upper surface of the yoke plate 220.

As another example, when the yoke part 200 does not include the yoke plate 220, the vibration part 310 of the elastic part 300 may be in contact with at least a part of the upper surface of the yoke body 210. A detailed description of the yoke part 200, the yoke body 210, and the yoke plate 220 is described above in FIG. 4.

The space 212 in which the elastic part 300 may vibrate may be formed on the upper surface of the yoke part 200 so that a part of the elastic part 300 may be in contact with a part of the upper surface of the yoke part 200 except for a part where the space 212 is formed.

According to an embodiment of the present disclosure, the vibration plate 400 may be in contact with the upper surface of the yoke part 200. The vibration plate 400 is in contact with the upper surface of the yoke part 200 and passes through the opening 330 of the elastic part 300 which is in contact with the upper surface of the yoke part 200 to be exposed to the outside.

Figure 11:
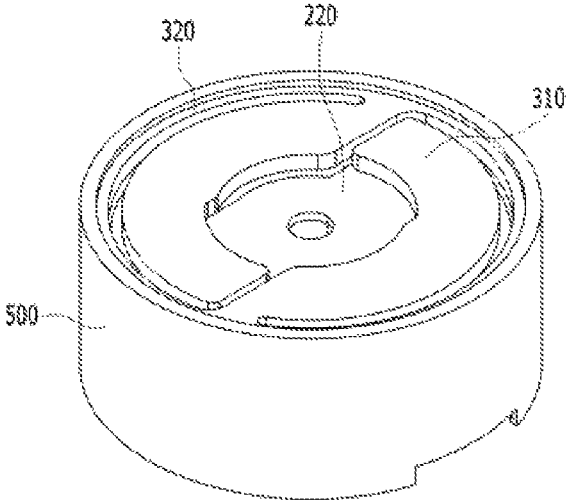
FIG. 11 illustrates a vibration output device including a housing according to an embodiment of the present disclosure.

FIG. 11 illustrates a vibration output device 1000 including a housing 500 according to an embodiment of the present disclosure.

According to an embodiment of the present disclosure, the vibration output device 1000 may include the housing 500.

The upper surface and a lower surface of the housing 500 are opened and side surfaces are closed, and as a result, the housing 500 may have a space therein. For example, the housing 500 may have a shape of a cylinder having the upper surface and the lower surface which are opened. Further, the housing 500 may have a shape of a rectangle having the upper surface and the lower surface which are opened, but is not limited thereto.

The housing 500 may include at least one component of the vibration output device 1000 in an internal space. For example, the internal space of the housing 500 may include the coil 130, the magnetic circuit 100, the yoke 200, the elastic part 300, or a combination thereof, but is not limited thereto.

The housing 500 may be molded into various members. The housing 500 may be formed of a metal member (e.g., iron, nickel, copper, etc.) and may be formed of reinforced plastic, but is not limited thereto.

According to an embodiment of the present disclosure, the housing 500 and the elastic part 300 may be coupled to each other in various methods. For example, the elastic part 300 is attached onto an inner surface of the housing 500 to be coupled to the housing 500. Further, the elastic part 300 may be coupled to the housing 500 by curling of the housing 500. For example, at least a part of the upper portion of the housing 500 is curled in the direction of the elastic part 300, so that the elastic part 300 may be seated on the upper surface of the housing 500.

The elastic part 300 is coupled to the housing 500 to be fixed. For example, the fixing part 320 of the elastic part 300 is coupled to the housing 500 to fix the elastic part 300 to the housing 500.

According to another embodiment, the elastic part 300 may be formed integrally with the housing 500. For example, the elastic part 300 and the housing 500 may be integrally formed by a casting method using a metal member, but are not limited thereto.

Figure 12:
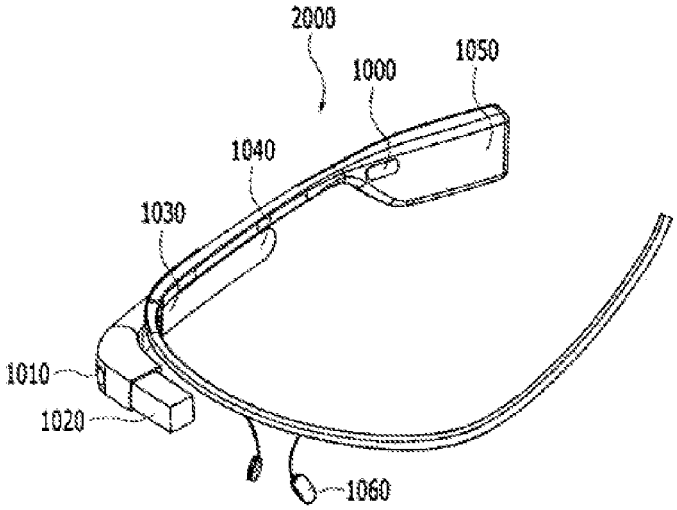
FIGS. 12 and 13 illustrate that the vibration output device according to an embodiment of the present disclosure is mounted on a portable electronic apparatus.
Figure 12:
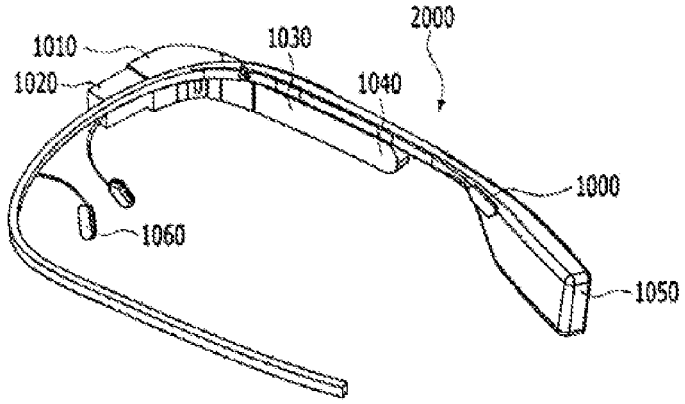
Figure 13:
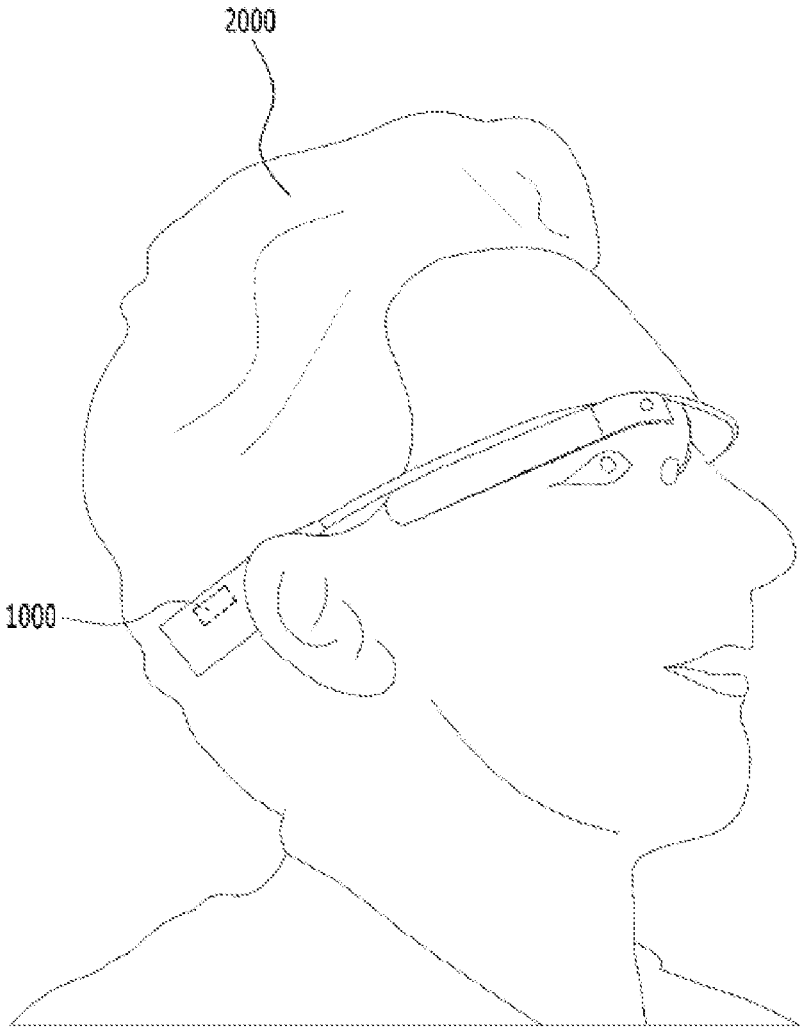

FIGS. 12 and 13 illustrate that the vibration output device 1000 according to an embodiment of the present disclosure is mounted on a portable electronic apparatus 2000.

Referring to FIGS. 12*a* and 12*b*, the vibration output device 1000 according to an embodiment of the present disclosure may be mounted inside the portable electronic apparatus 2000. Herein, the portable electronic apparatus 2000 may include Google glass 2000 by Google. The Google glass 2000 may include a camera 1010 capable of shooting an external image and a visual overlay 1020 capable of providing images to a user and the like. In addition, the Google glass 2000 may include a communication module 1030 capable of exchanging data with an external communication network and an operation processing unit 1040 such as a CPU capable of calculating received data. Further, the Google glass 2000 may include a rechargeable battery unit 1050 capable of supplying energy and a supporting means 1060 for assisting the user to wear like a pair of glasses.

According to an embodiment of the present disclosure, the Google glass 2000 may include the vibration output device 1000 having the magnetic circuit 100, the yoke part 200, and the elastic part 300. For example, it is preferable that the vibration output device 1000 is installed at a portion where the Google glass 2000 and a bone conduction region of the user or the like are in contact with each other.

As illustrated in FIG. 13, the user may wear the Google glass 2000 and receive a voice signal and a sound signal such as music as a vibration signal through the vibration output device 1000 provided in the Google glass 2000.

The present disclosure has been described with reference to the preferred embodiments. However, it will be appreciated by those skilled in the art that various modifications and changes of the present disclosure can be made without departing from the spirit and the scope of the present disclosure which are defined in the appended claims.

MODE FOR INVENTION

Related contents in the best mode for carrying out the present disclosure are described as above.

INDUSTRIAL APPLICABILITY

The present disclosure may be used in various electronic apparatuses using bone conduction technology.

The invention claimed is:

1. A vibration output device comprising:

a magnetic circuit generating vibration;

a yoke part contacting an upper surface of the magnetic circuit;

an elastic part performing a vibration motion in contact with at least a part of the upper surface of the yoke part, wherein the elastic part includes at least two vibration parts which vibrate with the vibration of the magnetic circuit; and a vibration plate contacting at least a part of the upper surface of the yoke part and outputting the vibration to the outside with the vibration of the yoke part, wherein the yoke part includes:

a yoke body contacting the upper surface of the magnetic circuit, and a yoke plate provided on the upper surface of the yoke body and having a plurality of protruding surfaces on the upper surface of the yoke body, and having different shapes in accordance with the number of vibration parts, wherein the elastic part further includes:

at least one fixing part fixing the elastic part onto an inner surface of a housing, and at least one connection part connecting the fixing part and the vibration part, and wherein the vibration part is in contact with at least a part of the upper surface of the yoke part and the vibration part is located between the fixing part and the vibration plate.

2. The vibration output device of claim 1, wherein two vibration parts are provided, and wherein the yoke plate includes:

a plate body, and two protrusions located on the outer periphery of the plate body and each contacting at least a part of the vibration part.

3. The vibration output device of claim 1, wherein three vibration parts are provided, and wherein the yoke plate includes:

a plate body, and three protrusions located on the outer periphery of the plate body and each contacting at least a part of the vibration part.

4. The vibration output device of claim 1, wherein four vibration parts are provided, and wherein the yoke plate includes:

a plate body, and four protrusions located on the outer periphery of the plate body and each contacting at least a part of the vibration part.

5. The vibration output device of claim 1, further comprising:

the housing of which an upper surface and a lower surface are opened and side surfaces are closed to have a space therein.

6. The vibration output device of claim 1, further comprising:

a housing of which an upper surface and a lower surface are opened and side surfaces are closed to have a space therein; and a coil located inside the housing and receiving an alternating current signal provided from the outside, wherein the magnetic circuit vibrates with a change in magnetic field provided by the coil, and wherein at least a part of an upper portion of the housing is curled to couple the elastic part to the housing.

7. The vibration output device of claim 1, wherein the upper surface of the yoke body is molded in a shape of a circular plate, and wherein a bottom surface of the yoke body is molded in a shape in which a cylinder is attached to the center of the circular plate.

8. The vibration output device of claim 1, wherein the vibration plate and the yoke part are coupled to each other by a rivet.

9. The vibration output device of claim 1, wherein the magnetic circuit includes a magnet, a top plate, and a magnetic circuit guide, and wherein the magnet, the top plate, and the yoke body are coupled to each other by the magnetic circuit guide.

10. A vibration output speaker outputting sound using vibration, comprising:

a control unit controlling a vibration output unit to generate vibration, the vibration output unit generating the vibration under control of the control unit, wherein the vibration output unit includes:

a magnetic circuit generating the vibration, a yoke part contacting an upper surface of the magnetic circuit, an elastic part performing a vibration motion in contact with at least a part of the upper surface of the yoke part, the elastic part including at least two vibration parts which vibrate with the vibration of the magnetic circuit, and a vibration plate contacting at least a part of the upper surface of the yoke part and outputting the vibration to the outside with the vibration of the yoke part, and wherein the yoke part includes:

a yoke body contacting the upper surface of the magnetic circuit, and a yoke plate provided on the upper surface of the yoke body and having a plurality of protruding surfaces on the upper surface of the yoke body, and having different shapes in accordance with the number of vibration parts wherein the elastic part further includes:

at least one fixing part fixing the elastic part onto an inner surface of a housing, and at least one connection part connecting the fixing part and the vibration part, and wherein the vibration part is in contact with at least a part of the upper surface of the yoke part and the vibration part is located between the fixing part and the vibration plate.

* * * * *